US006750638B1

(12) United States Patent
Gang

(10) Patent No.: US 6,750,638 B1
(45) Date of Patent: Jun. 15, 2004

(54) LINEAR REGULATOR WITH OUTPUT CURRENT AND VOLTAGE SENSING

(75) Inventor: Elliot Lawrence Gang, Washington, DC (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/124,963

(22) Filed: Apr. 17, 2002

Related U.S. Application Data

(60) Provisional application No. 60/284,906, filed on Apr. 18, 2001.

(51) Int. Cl.[7] ..... G05F 1/40
(52) U.S. Cl. ..... 323/280
(58) Field of Search ..... 323/280, 281, 323/273, 274

(56) References Cited

U.S. PATENT DOCUMENTS 3,902,111 A * 8/1975 Pfisterer, Jr. ..... 323/280
5,408,173 A * 4/1995 Knapp ..... 323/285
5,680,035 A * 10/1997 Haim et al. ..... 323/277
5,939,867 A * 8/1999 Capici et al. ..... 323/277
6,246,221 B1 * 6/2001 Xi ..... 323/280
6,518,737 B1 * 2/2003 Stanescu et al. ..... 323/280

OTHER PUBLICATIONS

Dixon, "Average Current Mode Control of Switching Power Supplies", *Unitrode Application Note U–140*, pp. 3–356—3–369 1999 no month.

Heisley et al., "DMOS Delivers Dramatic Performance Gains To LDO Regulators", *EDN*, Jun. 22, 2000, pp. 141–150.

* cited by examiner

*Primary Examiner*—Shawn Riley
(74) *Attorney, Agent, or Firm*—John W. Branch; Darby & Darby P.C.

(57) ABSTRACT

A linear regulator includes at least two control loops that monitor different control variables of the output signal. The error signal of the first control loop serves as the reference signal for the second control loop. The conversion of one control variable to the other increases phase margin and improves stability of the frequency response. Also, a capacitor can be coupled to the output of the linear regulator to improve small signal and transient response.

16 Claims, 2 Drawing Sheets

LINEAR REGULATOR WITH OUTPUT CURRENT AND VOLTAGE SENSING

RELATED APPLICATION

This utility patent application claims the benefit under 35 United States Code § 119(e) of U.S. Provisional Patent Application No. 60/284,906 filed on Apr. 18,2001.

FIELD OF THE INVENTION

The present invention relates to linear output regulator circuits and, more particularly, to linear output regulator circuits having two control loops.

BACKGROUND OF THE INVENTION

Linear regulators typically include an error amplifier in a feedback loop for comparing an output level to a reference level. Due to the gain provided by the error amplifier, the feedback loop can cause the linear regulator to become unstable or oscillate under certain conditions. To ensure stability, the total gain of the feedback loop must be less than one (unity) when the signal response of the linear regulator is 360° out of phase. Many linear regulators employ an external capacitor connected in parallel with the load to ensure stability. This external capacitor provides a pole that causes an additional 20 dB/decade of roll off in the feedback loop so that the gain of the loop will be less than one before the phase response has shifted 360°.

The value of the external capacitor is chosen to introduce a pole so that the gain of the feedback loop is less than one when the phase response shifts 360°. In addition, this capacitance helps transient response by providing fast current response to changes in the output current of the linear regulator. However, the linear regulators can still be susceptible to oscillation if the value of the external capacitor does not stay within a relatively tight tolerance. Therefore, it is desirable to increase the phase margin in linear regulators without increasing the external capacitance.

SUMMARY OF THE INVENTION

In accordance with aspects of the present invention, a linear regulator with two control loops is provided. In one aspect of the present invention, the linear regulator includes an outer control loop, an inner control loop, an output energy storage device, and a power modulator. The outer control loop and the inner control loop monitor different control variables where conversion from one control variable to the other provides a positive phase shift. For example, in one embodiment, the outer control loop monitors voltage and the inner control loop monitors current, where conversion from voltage to current monitoring provides a positive phase shift.

In operation, the outer control loop monitors a first control variable of the output signal of the linear regulator by comparing the level of the first control variable of the output signal to a reference level. The first control loop then generates an error signal related to the difference between the reference level and the first control variable level. An inner control loop monitors a second control variable of the output signal by comparing the level of the second control variable to the level of the error signal of the outer control loop. That is, the error signal of the outer control loop serves as the reference value of the inner control loop. Also, the error signal of the inner control loop then serves as the control signal of the power modulator, which provides the output signal to a load.

An energy storage device, e.g., a capacitor, is connected in parallel to the load to provide a compensating pole and improve transient response of the linear regulator. The outer control loop regulates the output signal by regulating the first control variable. In this aspect, the first control variable is selected to be the more slowly varying control variable between the first and second control variables. Similarly, the inner control loop regulates the output signal by regulating the second control variable. Also, because the conversion from the first control variable to the second control variable provides a positive phase shift, the use of an inner control loop provides an additional degree of phase margin, thereby improving stability.

In another aspect of the present invention, a multi-loop linear voltage regulator is provided. The multi-loop linear voltage regulator includes a voltage error amplifier, a current error amplifier, a pass transistor, a voltage to current converter, and an output capacitor. The pass transistor is connected to a power source and provides an output signal to the load. The voltage-to-current converter monitors the voltage level of the output signal and outputs a current having a level that is dependent on the output voltage level. The voltage error amplifier compares the output voltage to a reference voltage. The voltage error amplifier outputs an error current signal having a level that depends on the difference between the output voltage and the reference voltage. The current error amplifier compares the error current signal to the output current of the voltage-to-current converter and provides a control signal to the pass transistor having a level that is dependent on this difference. The voltage error amplifier provides a relatively slow voltage regulation, with the output capacitor providing stability and improved transient response. The current error amplifier provides a fast current regulation while gaining about 90° of phase margin, thereby improving both stability and small signal response.

DETAILED DESCRIPTION OF THE PREFERRED EMBODIMENT

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

The present invention provides for a voltage regulator with multiple control loops that enable a relatively linear response. The regulator includes a voltage error amplifier, a current error amplifier, a pass transistor, a voltage to current converter, and an output capacitor. The pass transistor is connected to a power source and provides an output signal to the load. The voltage-to-current converter monitors the voltage level of the output signal and outputs a current having a level that is dependent on the output voltage level. The voltage error amplifier compares the output voltage to a reference voltage. The voltage error amplifier outputs an error current signal having a level that depends on the difference between the output voltage and the reference voltage. The current error amplifier compares the error current signal to the output current of the voltage-to-current converter and provides a control signal to the pass transistor having a level that is dependent on this difference. The voltage error amplifier provides a relatively slow voltage regulation, with the output capacitor providing stability and transient response. The current error amplifier provides a fast current regulation while gaining about 90° of phase margin, thereby improving both stability and small signal response.

Figure 1:
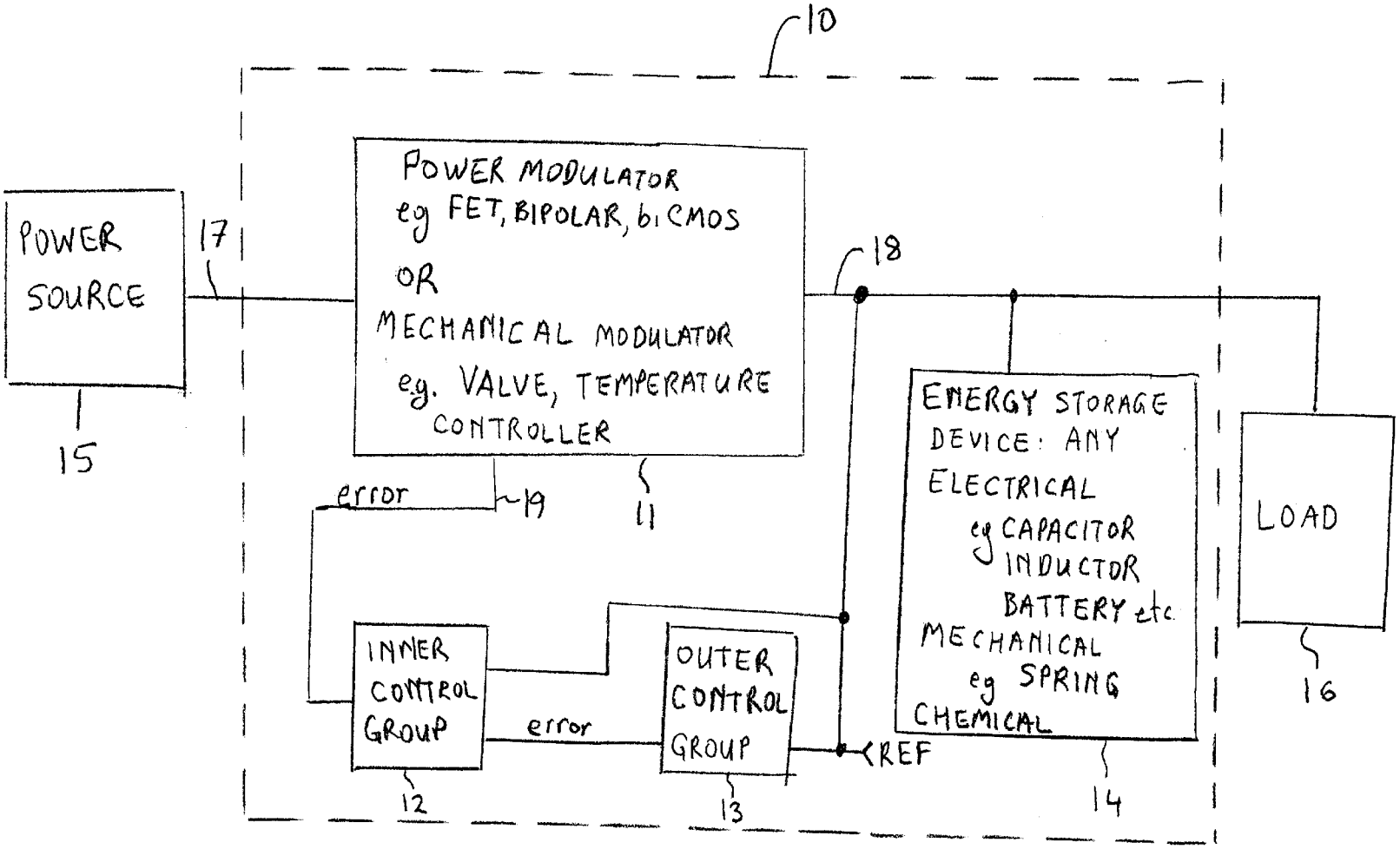
FIG. 1 illustrates a block diagram of a linear regulator.

FIG. 1 illustrates a block diagram of a linear regulator 10. Linear regulator 10 includes a power modulator 11, an inner control loop 12, an outer control loop 13, and an energy storage device 14. Power modulator 11 is connected to a power source 15 through an input node 17 and to a load 16 through an output node 18. Inner control loop 12, outer control loop 13 and energy storage device 14 are also connected to output node 18. Outer control loop 13 is connected to receive a reference signal and provides an error signal to inner control loop 12. Inner control loop 12 provides another error signal to power modulator 11 through control node 19.

Outer control loop 13 and inner control loop 12 monitor different control variables of the output signal present at output node 18. In particular, conversion from the second control variable to the first control variable provides a phase shift that is opposite in polarity compared to the phase shift provided by first control loop. For example, in one embodiment, outer control loop 13 monitors voltage and inner control loop 12 monitors current. The conversion of voltage to current in this example provides a positive phase shift.

In operation, outer control loop 13 monitors a first control variable of the output signal of linear regulator 10 by comparing the level of the first control variable of the output signal to a reference level. Outer control loop 13 then generates an error signal related to the difference between the reference level and the first control variable level. Inner control loop 12 monitors a second control variable of the output signal by comparing the level of the second control variable to the level of the error signal of outer control loop 13. That is, the error signal of outer control loop 13 serves as the reference value of inner control loop 12. The error signal of inner control loop 12 is received by power modulator 11 via control node 19. This error signal serves as the control signal of power modulator 11, which in response thereto modulates the signal from power source 15 to be provided to load 16.

Energy storage device 14 provides a compensating pole and improves transient response by serving as a transient current source. Preferably, energy storage device 14 is sized to keep the output signal within tolerance in response to the maximum specified power step. Outer control loop 13 regulates the output signal by regulating the first control variable. In this aspect of the present invention, the first control variable is selected to be the more slowly varying control variable between the first and second control variables. Inner control loop 12 regulates the output signal by regulating the second control variable. Because the conversion from the first control variable to the second control variable provides a positive phase shift, the use of an inner control loop provides an additional degree of phase margin, thereby improving stability.

In accordance with embodiments of the present invention, the first and second control variables can be parameters such as but not limited to voltage, current, pressure, and temperature. In addition, energy storage device 14 may be a capacitor, inductor, or spring or other mechanical, chemical or electrical energy storage device. Power modulator 11 may be a transistor such as MOSFET (N-type or P-type), power MOSFET, bipolar, lateral bipolar, biCMOS, etc., or a mechanical modulator such as a valve or temperature controller. Inner and outer control loops 12 and 13 can be differential amplifiers, or any sensor device that can compare one sensed parameter with another sensed parameter, such as a temperature, or pressure.

Figure 2:
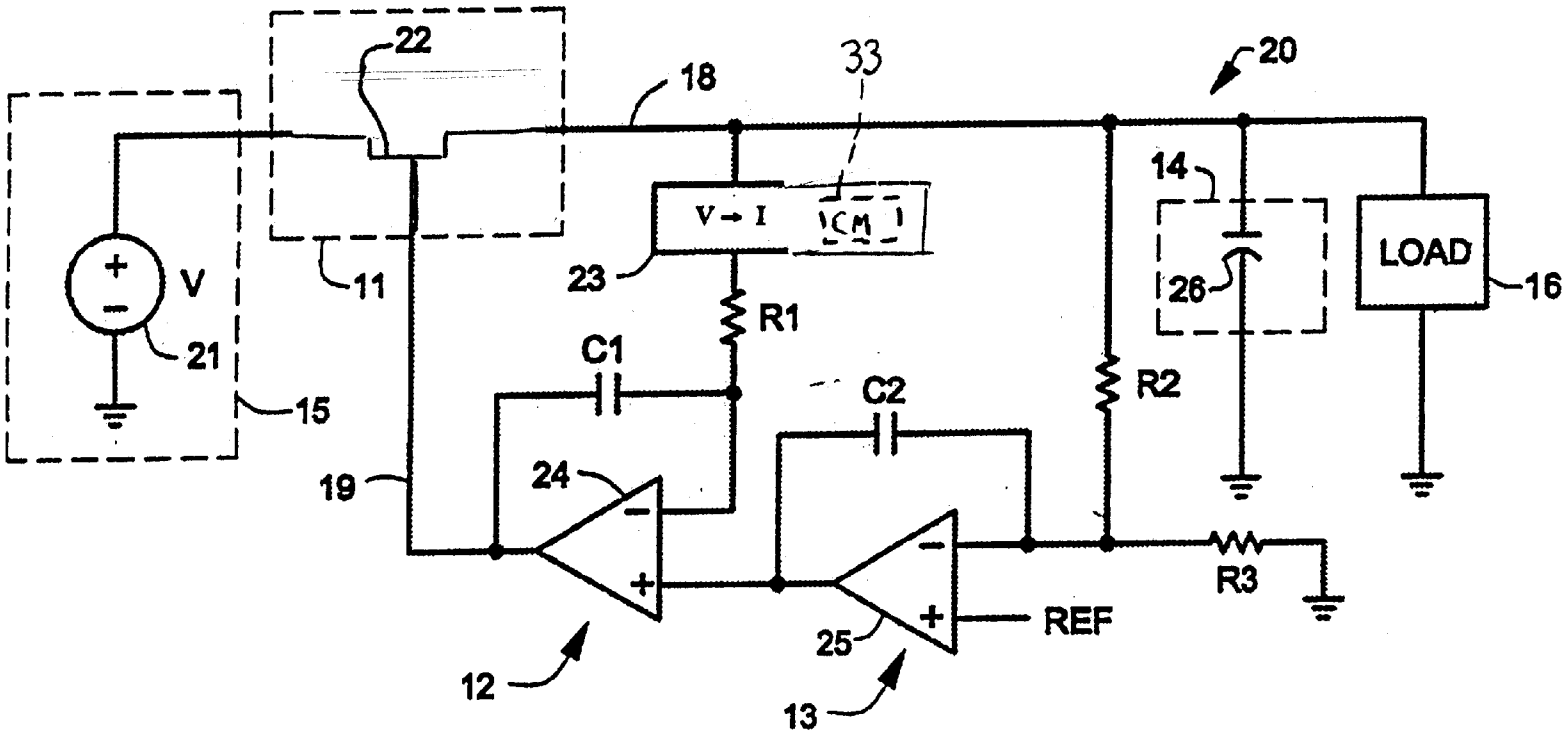
FIG. 2 illustrates a circuit diagram of linear voltage regulator in accordance with the present invention.

FIG. 2 shows a multi-loop linear voltage regulator 20 according to one embodiment of the invention. Linear voltage regulator 20 is one possible implementation of linear regulator 10 (FIG. 1). In this embodiment, power modulator 11 is implemented with a transistor 22 (also known as a pass transistor). Inner loop 12 is implemented with a voltage-to-current converter 23, a resistor R1, a capacitor C1, and a differential amplifier 24. Outer loop 13 is implemented with a voltage divider configuration that includes resistors R2 and R3, a capacitor C2, and a differential amplifier 25. Energy storage device is implemented with a capacitor 26. Capacitors C1 and C2 model the capacitance of differential amplifiers 24 and 25, respectively, which introduce poles in the frequency response of linear regulator 10.

Linear voltage regulator 20 is interconnected as follows. Transistor 22 is connected to conduct current from voltage source 21 to output node 18, modulated by the control signal present at control node 19. Capacitor 26 and load 16 are coupled between output node 18 and a ground bus. Resistor R2 is coupled in series between an end of resistor R3 and output node 18. Another end of resistor R3 is coupled to the ground bus. An inverting terminal of differential amplifier 25 is coupled to the ends of resistors R2 and R3, and its non-inverting terminal is coupled to a reference voltage. The reference voltage is typically provided by a bandgap reference (not shown). Capacitor C2 is coupled between the output and inverting terminal of differential amplifier 25. Voltage-to-current converter 23 is coupled to output node 18 and to one end of resistor R1. Another end of resistor R1 is coupled to an inverting terminal of differential amplifier 24. A non-inverting terminal of differential amplifier 24 is coupled to an output terminal of differential amplifier 25. Capacitor C1 is coupled between inverting and output terminals of differential amplifier 24. Also, the output terminal of differential amplifier 24 is coupled to control node 19.

In operation, the voltage divider created by the configuration of resistors R2 and R3 divide down the voltage level present at output node 18. Differential amplifier 25 receives the divided down voltage level and compares it to the reference voltage, thereby generating an error signal that is outputted to the non-inverting terminal of differential amplifier 24. In this embodiment, the error signal current is dependent on the difference between the divided down voltage level and the reference voltage. Differential amplifier 24 compares the error signal with the current generated by voltage-to-current converter 23.

In one embodiment, voltage-to-current converter 23 is implemented using a current mirror CM 33. Alternatively, current sense resistors may be used instead. Differential amplifier 24 generates the control signal for transistor 22 based on the difference between the currents provided by voltage-to-current converter 23 and differential amplifier 25. In one embodiment, the control signal is a voltage and transistor 22 is a field effect transistor. In other embodiments, the control signal is a current and transistor 22 is a bipolar or biCMOS transistor.

Linear voltage regulator 20 has several advantages over conventional single loop linear voltage regulators. For example, because the voltage-to-current conversion used in inner control loop 12 adds about 90° of phase shift, the phase margin is increased, thereby improving stability. The increased phase margin in turn enables capacitor 14 to have a smaller value, thereby decreasing cost and improving frequency response of linear voltage regulator 20. Inner loop 12 has a fast response time in regulating output current, while outer loop 13 has a relatively slow response time in regulating output voltage. Capacitor 26 is sized to average the output current over the outer loop bandwidth and provide a transient response so that the voltage ripple at the maximum specified current step is within a specified tolerance. Consequently, equivalent voltage regulation is achieved with increased phase margin, thereby improving stability.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A linear regulator for providing a regulated output signal, comprising:

(a) a transresistor that includes an input node, an output node and a control node, wherein the input node is coupleable to a power source;

(b) a control loop circuit coupled to the output node, wherein the control loop circuit monitors a control variable of the regulated output signal and generates an error signal at an error node that is dependent on a difference between a reference signal level and a level of the control variable; and (c) another control loop circuit coupled to the error node, the output node and the control node, wherein the other control loop circuit is configured to monitor another control variable of the regulated output signal and to generate at the control node a control signal that is dependent on a difference between a level of the error signal and a level of the other control variable, wherein the regulated output signal is dependent on a level of the control signal, wherein one of the control variable and the other control variable is indicative of one of temperature and pressure.

2. The linear regulator of claim 1, wherein the transresistor comprises a transistor.

3. The linear regulator of claim 1, further comprising an energy storage device coupled to the output node.

4. The linear regulator of claim 3, wherein the energy storage device comprises at least one of a capacitor, inductor, spring, and other storage device of one of mechanical, chemical and electrical energy.

5. The linear regulator of claim 1, wherein the control loop circuit comprises a differential amplifier and a voltage divider.

6. The linear regulator of claim 1, wherein the other control loop circuit comprises another differential amplifier and a voltage-to-current converter.

7. The linear regulator of claim 6, wherein the voltage-to-current converter comprises a current mirror.

8. A linear regulator for providing an output signal, comprising:

(a) means for changing a signal received at an input node responsive to a control signal received at a control node, the changed signal serving as the output signal;

(b) means for generating an error signal at an error node, the error signal being dependent on a difference between a level of a reference signal and a level of a control variable of the output signal; and (c) means for generating the control signal, the control signal being dependent on a difference between a level of the error signal and a level of another control variable of the output signal, wherein one of the control variable and the other control variable is indicative of one of temperature and pressure.

9. The linear regulator of claim 8, further comprising means for another control loop circuit that converts voltage to current.

10. The linear regulator of claim 9, wherein the means for converting voltage to current comprises a current mirror.

11. A linear regulator for providing a regulated output signal, comprising:

(a) a mechanical power modulator that includes an input node, an output node and a control node, wherein the input node is coupleable to a power source;

(b) a control loop circuit coupled to the output node, wherein the control loop circuit monitors a control variable of the regulated output signal and generates an error signal at an error node that is dependent on a difference between a reference signal level and a level of the control variable; and (c) another control loop circuit coupled to the error node, the output node and the control node, wherein the other control loop circuit is configured to monitor another control variable of the regulated output signal and to generate at the control node a control signal that is dependent on a difference between a level of the error signal and a level of the other control variable, wherein the regulated output signal is dependent on a level of the control signal.

12. The linear regulator of claim 11, wherein the mechanical power modulator is a valve.

13. The linear regulator of claim 11, wherein the mechanical power modulator is a temperature controller.

14. The linear regulator of claim 11, further comprising an energy storage device coupled to the output node.

15. The linear regulator of claim 14, wherein the energy storage device comprises at least one of a capacitor, inductor, spring and other storage device of one of mechanical, chemical and electrical energy.

16. The linear regulator of claim 11, wherein one of the control variable and the other control variable is indicative of one of temperature and pressure.

* * * * *